US010415387B2

(12) United States Patent
Li et al.

(10) Patent No.: US 10,415,387 B2
(45) Date of Patent: Sep. 17, 2019

(54) HIGH-STRENGTH CONFINED CONCRETE SUPPORT SYSTEM FOR UNDERGROUND TUNNEL

(71) Applicants: SHANDONG UNIVERSITY, Jinan, Shandong (CN); SHANDONG TIANQIN MINING MACHINERY EQUIPMENT CO. LTD., Heze, Shandong (CN)

(72) Inventors: Shucai Li, Jinan (CN); Qi Wang, Jinan (CN); Bei Jiang, Jinan (CN); Yingcheng Luan, Jinan (CN); Qian Qin, Jinan (CN); Huibin Sun, Jinan (CN); Hengchang Yu, Jinan (CN); Zhaonan Zeng, Heze (CN)

(73) Assignees: SHANDONG UNIVERSITY, Jinan (CN); SHANDONG TIANQIN MINING MACHINERY EQUIPMENT CO. LTD., Heze (CN)

( * ) Notice: Subject to any disclaimer, the term of this patent is extended or adjusted under 35 U.S.C. 154(b) by 0 days.

(21) Appl. No.: 15/767,157

(22) PCT Filed: Dec. 22, 2016

(86) PCT No.: PCT/CN2016/111551

§ 371 (c)(1),
(2) Date: Apr. 10, 2018

(87) PCT Pub. No.: WO2018/006558

PCT Pub. Date: Jan. 11, 2018

(65) Prior Publication Data

US 2018/0291736 A1 Oct. 11, 2018

(30) Foreign Application Priority Data

Jul. 8, 2016 (CN) ..... 2016 1 0538204
Jul. 8, 2016 (CN) ..... 2016 1 0538213
Jul. 8, 2016 (CN) ..... 2016 1 0538558

(51) Int. Cl.
*E21D 11/18* (2006.01)
*E21D 11/24* (2006.01)
(Continued)

(52) U.S. Cl.
CPC ..... *E21D 11/183* (2013.01); *E21D 11/10* (2013.01); *E21D 11/24* (2013.01); *E21D 21/006* (2016.01); *E21D 21/02* (2013.01)

(58) Field of Classification Search
CPC ..... E21D 11/18; E21D 11/186; E21D 11/183; E21D 11/22; E21D 11/28; E21D 11/14; E21D 11/152
(Continued)

(56) References Cited

U.S. PATENT DOCUMENTS 3,751,929 A * 8/1973 Bernold ..... E01C 3/006 405/150.1
4,187,037 A * 2/1980 Seiz ..... E21D 11/18 405/146
(Continued)

FOREIGN PATENT DOCUMENTS

CA 2678136 A1 * 3/2011 ..... E21D 11/152
CA 2785782 A1 * 8/2011 ..... E21D 11/18
(Continued)

OTHER PUBLICATIONS

Mar. 22, 2017 International Search Report issued in International Patent Application No. PCT/CN2016/111551.

*Primary Examiner* — Frederick L Lagman
(74) *Attorney, Agent, or Firm* — Oliff PLC

(57) ABSTRACT

A high-strength confined concrete support system for an underground tunnel. The support system includes multiple confined concrete arches, bolts and cables, and a prestressed
(Continued)

steel strand backfilling system. The confined concrete arches all support the surrounding rock of the tunnel and are sequentially arranged along the tunnel. Every two adjacent confined concrete arches are connected by a longitudinal connection structure. The support system is provided with a plurality of layers of steel bar meshes on the surrounding rock side and the tunnel side, and shotcrete layers are sprayed on the support system and the steel bar meshes. The prestressed steel strand backfilling system comprises a prestressed steel strand system and a filling material. The filling material fills the space between each confined concrete arch and the surrounding rock to equalize a load on the confined concrete arch and generate prestress.

18 Claims, 5 Drawing Sheets

(51) Int. Cl.
*E21D 21/00* (2006.01)
*E21D 21/02* (2006.01)
*E21D 11/10* (2006.01)

(58) Field of Classification Search
USPC ..... 405/302.2, 302.3; 299/11
See application file for complete search history.

(56) References Cited

U.S. PATENT DOCUMENTS

| | | | | | |
|---|---|---|---|---|---|
| 4,413,928 | A * | 11/1983 | Tucker | E21D 20/02 405/259.5 |
| 4,634,318 | A * | 1/1987 | Koumal | E21D 11/006 405/259.3 |
| 2008/0279627 | A1 * | 11/2008 | Junker | E21D 11/152 404/75 |

FOREIGN PATENT DOCUMENTS

| | | | | | |
|---|---|---|---|---|---|
| CA | 2949217 | A1 * | 12/2015 | | E21D 11/28 |
| CN | 101280684 | A | 10/2008 | | |
| CN | 101749034 | A | 6/2010 | | |
| CN | 102839981 | A | 12/2012 | | |
| CN | 202882939 | U | 4/2013 | | |
| CN | 105569672 | * | 5/2016 | | |
| CN | 105569699 | * | 5/2016 | | |
| CN | 105604583 | * | 5/2016 | | |
| DE | 2503014 | A1 * | 7/1976 | | E21D 11/52 |
| DE | 3243852 | A1 * | 6/1984 | | E21D 11/006 |
| DE | 3602484 | A1 * | 7/1987 | | E21D 11/152 |
| EP | 0156087 | A1 * | 10/1985 | | E21D 11/006 |
| FR | 2261408 | A1 * | 9/1975 | | E21D 11/006 |
| GB | 933861 | A * | 8/1963 | | E21D 11/152 |
| GB | 2155079 | A * | 9/1985 | | E21D 11/006 |
| JP | H08-068300 | A | 3/1996 | | |
| WO | WO-2015179883 | A2 * | 11/2015 | | E21D 11/18 |

* cited by examiner

HIGH-STRENGTH CONFINED CONCRETE SUPPORT SYSTEM FOR UNDERGROUND TUNNEL

TECHNICAL FIELD

The present invention relates to a high-strength confined concrete support system for an underground tunnel.

BACKGROUND

With the rapid development of the scale and speed of underground works, an increasing number of underground works such as coal mine roadways, highway and railway tunnels and large hydropower stations are being constructed with increasing newer and higher requirements on tunnel support. It can be expected in the coming decades that a large number of tunnels having such distinct characteristics as large section, large burial depth, high stress, long tunnel line and soft-fractured surrounding rock will be constructed under complex geological conditions, and the safety and stability problems of long-span tunnels under the circumstance of weak-broken surrounding rock are becoming increasingly serious.

For the characteristics of big deformation and difficulties in support of traditional deep soft rock chambers, special researches have been made on the patterns of support for large section chambers with deep high-stress soft rock at home and abroad, which have gone through traditional forms such as traditional bolt-shotcrete support, steel fiber reinforced shotcrete support and flexible steel bracket support to the form of bolt-mesh-shotcrete and flexible steel bracket combined support, etc. These support forms, however, often produce support effects that are not obvious, and mostly are insufficient in support resistance and not high in support strength.

In general, tunnel support under the conditions of deep high stress soft rock and fractured rock mass exhibits the problems of big deformation and difficulties in support. The prior art can hardly meet the support requirements of underground works such as roadways and tunnels with complex geological conditions, thereby seriously affecting the production and safety of the underground works. Therefore, there is now an urgent need for a new high-strength support system capable of effectively controlling deformation of the large section with large section and fractured surrounding rock.

Chinese patent application No. 2012103596417 entitled "Three-Dimensional Prestressed Steel Strand Backfilling Bracket Support System for Deep Soft Rock Roadway" provides a support system. Such a support system, unfortunately, is limited to a range of applications in roadways without solving the technical problem of big deformation of soft-fractured surrounding rock that soft rock tunnel construction faces. This invention may have the following disadvantages: in the event of tunnel crossing soft-fractured surrounding rock, excavation disturbance will inevitably cause big surrounding rock deformation, which may eventually result in tunnel face instability and tunnel collapse due to insufficient supporting force and consequent heavy economic losses.

SUMMARY OF THE INVENTION

To solve the above problems, the present invention provides a high-strength confined concrete support system for an underground tunnel. The high-strength confined concrete support system for an underground tunnel has higher integrality. Prestressed steel strands and a filling material interact to form a middle bearing layer of the support system, thereby effectively connecting internal and external bearing structures together to form a three-dimensional integral bearing structure. Thus, jointly bearing by a bracket, a filler and the surrounding rock is realized with achieved coupling of the support body and the surrounding rock in strength, rigidity and structure. As a result, partial failure of the support system is effectively prevented, and the stability of support is improved.

To achieve the above object, the present invention employs the following technical solutions.

A high-strength confined concrete support system for an underground tunnel comprises multiple confined concrete arches, bolts and cables, and a prestressed steel strand backfilling system, wherein the confined concrete arches form an internal bearing layer of the support system; the bolts and the cables form an external bearing layer of the support system; the bolts and the cables are embedded into the surrounding rock; and a filling material is injected between the arches and the surrounding rock to form an intermediate bearing structure layer.

The confined concrete arches all support surrounding rock of the tunnel and are sequentially arranged along the tunnel. Every two adjacent confined concrete arches are connected by a longitudinal connection structure. The support system is provided with a plurality of layers of steel bar meshes on the surrounding rock side and the tunnel side, and shotcrete layers are sprayed over the support system and the steel bar meshes.

The prestressed steel strand backfilling system comprises a prestressed steel strand system and a filling material; the prestressed steel strand system refers to that steel strands for connecting the arches with the bolts and the cables sequentially run through arch cable-passing holes and tray cable-passing holes to form a continuous grid between outer edges of the arches and the surface of the surrounding rock, thereby connecting the arches with the bolts and the cables.

The filling material fills the space between each confined concrete arch and the surrounding rock to equalize a load on the confined concrete arch and generate prestress.

Each confined concrete arch is an arch bracket structured by filling steel tubes with core concrete. The confined concrete arch may have different section shapes due to the fact that influencing factors such as lateral pressure coefficient, burial depth and geological condition of the tunnel are different.

The section may be square, circular, U-shaped, or the like. A square section may have high inertia moment and good anti-bending performance. A circular section steel tube may have a good confinement effect on the core concrete with excellent axial compressive performance. Tunnel section types to which the confined concrete arches are applicable include a circular shape, an oval shape, a vertical-wall semicircular shape, a U-shape, a multi-center circular shape, and the like.

Each confined concrete arch is constituted by splicing a plurality of steel tubes. The steel tubes are connected by joints. Each joint is in a flanged connection mode. Every two steel tubes are connected by a welded flange plate and by using a bolt. A plurality of stiffening ribs are welded around the connection of the flange plate and each steel tube to reinforce weak connection positions of the joint.

Each confined concrete arch is constituted by splicing a plurality of steel tubes. The steel tubes are connected by joints. The joints are connecting pieces. Each connecting piece comprises two ring-shaped steel elements which are connected by a hinge, and when two steel tubes are folded, the joint is closed and fixed in position by using a snap spring.

Further, telescopic structures are disposed at arch legs confined concrete arch. Thus, ground overbreak can be effectively reduced, and the arch legs can reach specified positions conveniently when an overall arch is installed.

Further, the steel tubes confined concrete arch are filled with core concrete. The core concrete may be ordinary concrete or steel fiber reinforced concrete, which is specifically selected depending on site specific conditions. The strength grade of the concrete ranges from C20 to C70. Meanwhile, a certain proportion of pumping aid and early strength agent is added. The confined concrete arches are easy to fill with their strength improving quickly. Besides, the setting time of concrete may be adjusted according to the site surrounding rock conditions so that the axial compression strength can reach 80% and above of the final strength.

The confined concrete arches are provided with reinforcement structures at grouting openings. Each grouting opening reinforcement structure includes lateral bending steel plate reinforcement, opening steel plate reinforcement and/or peripheral steel plate reinforcement. A ratio of the thickness of each steel plate to the wall thickness of each steel tube of the arch is 0.5-4, and the length of the steel plate is 1.2-3 times the diameter of each grouting opening. By reinforcement, the stress concentration degree is reduced and the ultimate bearing capacity is improved.

Ribbed plates are disposed on each confined concrete arch, and the ribbed plates are welded at inner and outer sides of the arch. The length of each ribbed plate is greater than the width of the arch by 10 mm to 200 mm, and the ribbed plate is higher than the plane of the arch by 5 mm to 100 mm; and the distance between the ribbed plates ranges from 500 mm to 30000 mm. The ribbed plates can increase the contact area of the arch and the shotcrete layer, improve the interaction force of the arch and the shotcrete layer, and enhance the adhesion and integrity of the arch and the concrete.

The longitudinal connection structure is longitudinal connecting bars which are welded between adjacent two confined concrete arches and alternately welded at surrounding rock sides and tunnel sides of different confined concrete arches; and the longitudinal connecting bars can be welded on both the surrounding rock side and the tunnel side.

The longitudinal connection structure is a longitudinal connecting rod; one end of a connecting steel bar is provided with a thread for connection with a connector on a confined concrete arch before the confined concrete arch is installed; the other end of the connecting steel bar is provided with a protrusion for insertion into a connector at a corresponding position of a previously assembled confined concrete arch when confined concrete arches are assembled; and then inverted wedge-shaped snap rings are utilized for automatic fixation to connect the two confined concrete arches.

The other end of the connecting steel bar of the longitudinal connecting rod is provided with an annular groove for insertion into a connector at a corresponding position of a previously confined concrete arch, and a tensioned snap spring is clamped in the annular groove for fixation.

Steel bars or steel plates are utilized to reinforce crucial load-carrying parts confined concrete arch. Steel bars or steel plates are welded at surrounding rock sides of the tops and lateral walls of each confined concrete arch to enhance the strength of the crucial positions and improve the overall bearing capacity of the arch.

The steel bar meshes are arranged between adjacent two confined concrete arches, respectively, which are double layers of steel bar meshes welded at both surrounding rock sides and tunnel sides of confined concrete arch, respectively. A welding distance between each steel bar mesh and each arch is equal to half the width of each confined concrete arch, such that the steel bar meshes at both sides of each arch can contact with each other. Coverage of the steel bar meshes can increase friction between the surface of each steel tube and each shotcrete layer providing better adhesion of each steel arch and the shotcrete layer, meanwhile, each steel bar mesh plays a role of a filling retaining plate for backfilling, thereby preventing the filling material from flowing and facilitating the backfilling.

The shotcrete layer may be formed by ordinary C20-C40 concrete or steel fiber reinforced concrete. Thus, the anti-tensile, anti-bending, anti-impact and anti-fatigue properties of the concrete are significantly improved with good ductility.

According to the site geological conditions, the distance between the confined concrete arches may be appropriately increased and the thickness of the shotcrete layer may be appropriately reduced in contrast with the arches in traditional support forms.

A steel bar enclosure may be externally welded on each confined concrete arch. The steel bar enclosure comprises four main bars, a plurality of stirrups, truss bars and U-shaped bars. The four main bars are disposed at four sides of the confined concrete arch, respectively, and connected with the confined concrete arch by means of fasteners, and the main bars are in parallel with the confined concrete arch. The stirrups are distributed on a radial plane in the direction of the arch to enclose the main bars and the confined concrete arch; and the truss bars and the U-shaped bars are fixed between the adjacent main bars. Such a design may improve the stability of the system and the adhesion to the shotcrete layer with better integrity.

Each confined concrete arch is constituted by splicing a plurality of steel tubes. The steel tubes are connected by quantitative yielding joints, and each joint is constituted by a quantitative yielding device, a sleeve and a retaining collar. The quantitative yielding device is mounted between the ends of two sections of the arch. The ends of two sections of the arch are connected by using the sleeve. The retaining collar is located at the lower side of the sleeve.

Each confined concrete arch is constituted by splicing a plurality of steel tubes. The steel tubes are connected by a sleeve. The sleeve encloses the arch with a certain gap between the sleeve and the arch to facilitate the sleeve enclosing the arch during construction. Moreover, a check block is disposed below the sleeve to prevent the sleeve from sliding down.

The quantitative yielding device is fabricated as required by design. When a load on an arch reaches a certain limit, the quantitative yielding device can achieve yielding through the deformation thereof, and has a yielding point and a yielding quantity. It may also be fabricated as a yielding device having different yielding points and yielding quantities, which may be selected as required in use.

The quantitative yielding device has a particular load-displacement curve form under pressure, which, as required, is a constant-resistance yielding form where deformation continues and the load remains unchanged when the pressure reaches a certain degree, a resistance-increased yielding form where the load and the deformation slowly increase at the same time, a phased yielding, or the like.

The quantitative yielding device is a two-section I-shaped structure with both sides recessed, such that the overall apparent shape is an arc shape or a cylindrical shape and the section shape is a circular shape.

The bolts are high-strength bolts or grouted bolts, and the cables are high-strength cables or grounded cables.

The prestressed steel strand system refers to that steel strands for connecting the arches with the bolts and the cables sequentially run through arch cable-passing holes and tray cable-passing holes to form a similarly W-shaped continuous grid between outer edges of the arches and the surface of the surrounding rock, thereby connecting the arches with the bolts and the cables. The steel strands may be selected from a plurality of types with a diameter generally ranging from 4 mm to 10 mm, and there may be a plurality of layouts of the steel strands without being limited to the W-shape and Z-shape.

The filling material may be a concrete type material, and in particular foam concrete and steel fiber reinforced concrete. By backfilling, the characteristics of yielding and high strength are realized with short initial setting time and high early strength. The filling material may be a mixed material having certain plastic deformation capacity and excellent pumpability, and may be injected by way of pumping with greatly reduced labor intensity.

The filling material effectively fills the space between each bracket and the surrounding rock, such that a load uniformly bears on the bracket and the high-strength supporting capacity of the bracket is brought into full play.

The filling material allows the generation of a certain prestress therein under the action of the prestressed steel strands to form a structure similar to prestressed concrete, thereby effectively improving the overall strength and the plastic deformation capacity of the filling material layer, making up the shortfall of brittleness of the filling material, enhancing the overall strength and the anti-deformation capability of the filling material and preventing its partial cracking failure.

Beneficial Effects of the Present Invention:

(1) The support system in the present invention has higher integrality. The prestressed steel strands and a filling material interact to form a middle bearing layer of the support system, thereby effectively connecting internal and external bearing structures together to form a three-dimensional integral bearing structure. Therefore, common bearing by a bracket, a filler and the surrounding rock is realized with achieved coupling of the support body and the surrounding rock in strength, rigidity and structure. As a result, partial failure of the support system is effectively prevented, and the stability of support is improved.

(2) The support system has the advantages of high strength and ductility of the steel and compressive resistance and low manufacturing cost of the concrete, and is 2-3 times higher in bearing capacity than a traditional U-shaped mine support steel arch with the same steel content in section; under the confinement action of the external steel tubes, the internal concrete may have higher compressive strength. Common bearing by the steel tubes and the concrete therein may meet the requirement of controlling the deformation of the surrounding rock of the tunnel.

(3) In terms of the support costs, for the confined concrete, the disclosed support system has the support costs increased by 20% around in the core concrete and the backfilling material. However, due to its tremendous bearing capacity, high expenses of multiple repairs are avoided. Therefore, the disclosed support system has significant economic benefits.

(4) According to the present invention, to better adhere the arches with the shotcrete layers without stripping under the load of the surrounding rock, the reinforcing ribbed plates are welded on the arches. The adjacent confined concrete arches are automatically connected by using the longitudinal connecting bars with the snap springs or welded by using ordinary steel bars. The greater load-carrying parts of the arches are reinforced by steel bars or steel plates.

BRIEF DESCRIPTION OF THE DRAWINGS

FIG. 4 (*b*) is an overall schematic diagram of a steel bar enclosure in the present invention;

Figure 1:
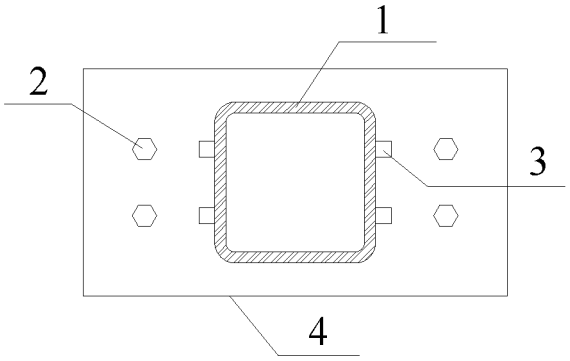
FIG. 1 is a schematic diagram of a flanged connection structure of a joint in the present invention.

Reference numerals in the figures are as follows: 1, arch; 2, high-strength bolt; 3, stiffening rib; 4, flange plate; 5, snap spring; 6, hinge; 7, joint abutting groove; 8, joint exhaust vent; 9, annular recess; 10, joint abutting protrusion; 11, reinforcing ribbed plate; 12, stirrup; 13, truss bar; 14, confined concrete arches; 15, core concrete; 16, main bar; 17, fastener; 18, U-shaped bar; A, near-surrounding rock side; B, near-tunnel side; 19, longitudinal connecting bar; 20, threaded base; 21, gland; 22, inverted wedge-shaped tensioned snap ring; 23, connecting rod protrusion; 24, abutting base; 25, flared abutting port; 26, tensioned ring-shaped snap ring; 27, reinforcing steel bar; 28, lateral bending steel plate reinforcement; 29, opening steel plate reinforcement; 30, peripheral steel plate reinforcement; 31, steel bar mesh; 32, sleeve; 33, retaining collar; 34, quantitative yielding device; 1-1, cable; 1-2, bolt; 1-3, surrounding rock; 1-4, steel strand; and 1-5, filling material.

DETAILED DESCRIPTION

The present invention will be further described below in connection with the accompanying drawings and embodiments.

Figure 12:
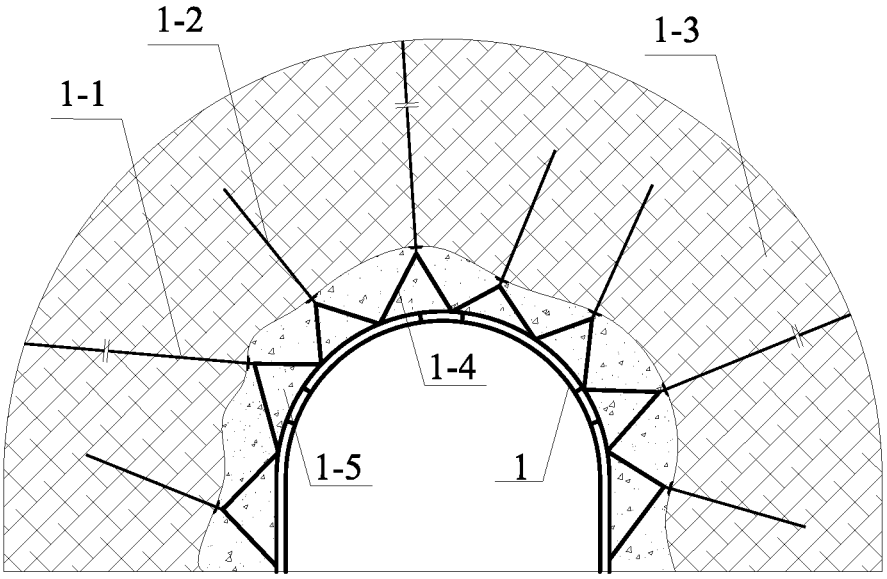
FIG. 12 is a schematic diagram of a confined concrete support system in the present invention.

As shown in FIG. 12, a high-strength confined concrete support system for an underground work tunnel comprises multiple confined concrete arches, bolts and cables, and a prestressed steel strand backfilling system. The confined concrete arches form an internal bearing layer of the support system. The bolts and the cables form an external bearing layer of the support system. The bolts and the cables are embedded into the surrounding rock. A filling material is injected between the arches and the surrounding rock to form an intermediate bearing structure layer. The arches are connected with the bolts and the cables by prestressed steel strands with a preload applied. The confined concrete arches support the surrounding rock of the tunnel and are sequentially arranged along the tunnel. Ribbed slabs are welded at both inner and outer sides of the arches and grouting holes and exhaust holes in the arches are reinforce. Moreover, steel bars or steel plates are welded at crucial load-carrying parts of the arches for reinforcement. The adjacent confined concrete arches are connected by a longitudinal connection structure. The support system is provided with a plurality of layers of steel bar meshes on the surrounding rock side and the tunnel side, and shotcrete layers are sprayed on the support system and the steel bar meshes.

Each confined concrete arch is an arch bracket structured by filling steel tubes with core concrete. The confined concrete arches may have different section shapes due to the fact that influencing factors such as lateral pressure coefficient, burial depth and geological condition of the tunnel could be different.

Preferably, the section may be square, circular, U-shaped, or the like. A square section may have high inertia moment and good anti-bending performance. A circular section steel tube may have a good confinement effect on the core concrete with excellent axial compressive performance. Tunnel section types to which the confined concrete arches are applicable include a circular shape, an oval shape, a vertical-wall semicircular shape, a U-shape, a multi-center circular shape, and the like.

The bolts are high-strength bolts or grouted bolts, and the cables are high-strength cables or grounded cables.

The prestressed steel strand system refers to that steel strands for connecting the arches with the bolts and the cables sequentially run through arch cable-passing holes and tray cable-passing holes to form a similarly W-shaped continuous grid between outer edges of the arches and the surface of the surrounding rock, thereby connecting the arches with the bolts and the cables. The steel strands may be selected from a plurality of types with a diameter generally ranging from 4 mm to 10 mm, and there may be a plurality of layouts of the steel strands without being limited to the W-shape and Z-shape.

The filling material may be a concrete type material, and in particular foam concrete and steel fiber reinforced concrete. By backfilling, the characteristics of yielding and high strength are realized with short initial setting time and high early strength. The filling material may be a mixed material having certain plastic deformation capacity and excellent pumpability, and may be injected by way of pumping with greatly reduced labor intensity.

Further, the filling material effectively fills the space between each bracket and the surrounding rock, such that a load uniformly bears on the bracket and the high-strength supporting capacity of the bracket is brought into full play.

Further, the filling material allows the generation of a certain prestress therein under the action of the prestressed steel strands to form a structure similar to prestressed concrete, thereby effectively improving the overall strength and the plastic deformation capacity of the filling material layer, making up the shortfall of brittleness of the filling material, enhancing the overall strength and the anti-deformation capability of the filling material and preventing its partial cracking failure.

There may be a plurality of connection modes for the confined concrete arches.

Further, each confined concrete arch is constituted by splicing a plurality of steel tubes. The steel tubes are connected by joints. Each joint is in a flanged connection mode. Every two steel tubes are connected by a welded flange plate and by using a bolt. A plurality of stiffening ribs are welded around the connection of the flange plate and each steel tube to reinforce weak connection positions of the joint.

Further, each confined concrete arch is constituted by splicing a plurality of steel tubes. The steel tubes are connected by joints. The joints are connecting pieces. Each connecting piece comprises two ring-shaped steel elements which are connected by a hinge, and when two sections of steel tubes are folded, the hinge is closed and fixed in position by using a snap spring.

Further, each confined concrete arch is constituted by splicing a plurality of steel tubes. The steel tubes are connected by quantitative yielding joints, and each joint is constituted by a quantitative yielding device, a sleeve and a retaining collar. The quantitative yielding device is mounted between the ends of two sections of the arch. The ends of two sections of the arch are connected by using the sleeve. The retaining collar is located at the lower side of the sleeve.

Further, each confined concrete arch is constituted by splicing a plurality of steel tubes. The steel tubes are connected by a sleeve. The sleeve encloses the arch with a certain gap between the sleeve and the arch to facilitate the sleeve enclosing the arch during construction. Moreover, a check block is disposed below the sleeve to prevent the sleeve from sliding down.

Preferably, the quantitative yielding device is fabricated as required by design. When a load on an arch reaches a certain limit, the quantitative yielding device can achieve yielding through the deformation thereof, and has a yielding point and a yielding quantity. It may also be fabricated as a yielding device having different yielding points and yielding quantities, which may be selected as required in use.

Preferably, the quantitative yielding device has a particular load-displacement curve form under pressure, which, as required, is a constant-resistance yielding form where deformation continues and the load remains unchanged when the pressure reaches a certain degree, a resistance-increased yielding form where the load and the deformation slowly increase at the same time, a phased yielding, or the like.

Preferably, the quantitative yielding device is a like two-section I-shaped structure with both sides recessed, such that the overall apparent shape is an arc shape or a cylindrical shape and the section shape is a circular shape.

The steel tubes confined concrete arch are filled with core concrete. The core concrete may be ordinary concrete or steel fiber reinforced concrete, which is specifically selected depending on site specific conditions. Meanwhile, a certain proportion of pumping aid and early strength agent is added. The confined concrete arches are easy to fill with their strength improving quickly. Besides, the setting time may be adjusted according to the site surrounding rock conditions, so that the early strength of the core concrete can quickly reach a designed value.

The confined concrete arches are provided with reinforcement structures at grouting openings. Each grouting opening reinforcement structure includes lateral bending steel plate reinforcement, opening steel plate reinforcement and/or peripheral steel plate reinforcement. The ratio of the thickness of each steel plate to the wall thickness of each steel tube of the arch is 0.5-4, and the length of the steel plate is 1.2-3 times the diameter of each grouting opening. By reinforcement, the stress concentration degree is reduced and the ultimate bearing capacity is improved.

Ribbed plates are disposed on each confined concrete arch, and the ribbed plates are welded at inner and outer sides of the arch. The length of each ribbed plate is greater than the width of the arch by 10 mm to 200 mm, and the ribbed plate is higher than the plane of the arch by 5 mm to 100 mm. The distance between the ribbed plates ranges from 500 mm to 30000 mm. The ribbed plates can increase the contact area of the arch and the shotcrete layer, improve the interaction force of the arch and the shotcrete layer, and enhance the adhesion and integrity of the arch and the concrete.

The adjacent confined concrete arches are connected by a longitudinal connection structure. There may be a plurality of forms of the longitudinal connection structure.

Further, the longitudinal connection structure is longitudinal connecting bars which are welded between adjacent two confined concrete arches and alternately welded at surrounding rock sides and tunnel sides of different confined concrete arches. The longitudinal connecting bars can be welded on both the surrounding rock side and the tunnel side.

Further, the longitudinal connection structure is a longitudinal connecting rod. One end of a connecting steel bar is provided with a thread for connection with a connector on a confined concrete arch before the confined concrete arch is installed; the other end of the connecting steel bar is provided with a protrusion for insertion into a connector at a corresponding position of a previously assembled confined concrete arch when confined concrete arches are assembled; and then inverted wedge-shaped snap rings are utilized for automatic fixation to connect the two confined concrete arches Preferably, the other end of the connecting steel bar of the longitudinal connecting rod is provided with an annular groove for insertion into a connector at a corresponding position of a previously confined concrete arch, and a tensioned snap spring is clamped in the annular groove for fixation.

Steel bars or steel plates are utilized to reinforce crucial load-carrying parts confined concrete arch. Steel bars or steel plates are welded at surrounding rock sides of the tops and lateral walls of each arch to enhance the strength of the crucial positions and improve the overall bearing capacity of the arch.

The steel bar meshes are arranged between adjacent two confined concrete arches, respectively, which are double layers of steel bar meshes welded at both surrounding rock sides and tunnel sides of confined concrete arch, respectively. A welding distance between each steel bar mesh and each arch is equal to half the width of each confined concrete arch, such that the steel bar meshes at both sides of each arch can contact with each other. Coverage of the steel bar meshes can increase friction between the surface of each steel tube and each shotcrete layer providing better adhesion of each steel arch and the shotcrete layer, meanwhile, each steel bar mesh plays a role of a filling retaining plate for backfilling, thereby preventing the filling material from flowing and facilitating the backfilling.

The shotcrete layer may be formed by ordinary concrete or steel fiber reinforced concrete. Therefore, the anti-tensile, anti-bending, anti-impact and anti-fatigue properties of the concrete are significantly improved with good ductility.

According to the site geological conditions, the distance between the confined concrete arches may be appropriately increased and the thickness of the shotcrete layer may be appropriately reduced in contrast with the arches in traditional support forms.

A steel bar enclosure may be externally welded on each confined concrete arch. The steel bar enclosure comprises four main bars, a plurality of stirrups, truss bars and U-shaped bars. The four main bars are disposed at four sides of the confined concrete arch, respectively, and connected with the confined concrete arch by means of fasteners, and the main bars are in parallel with the confined concrete arch. The stirrups are distributed on a radial plane in the direction of the arch to enclose the main bars and the confined concrete arch; and the truss bars and the U-shaped bars are fixed between the adjacent main bars. Such a design may improve the stability of the system and the adhesion to the shotcrete layer with better integrity.

(1) Relevant Parameters of the Confined Concrete Arches 1

Each confined concrete arch 1 is an arch bracket structured by filling steel tubes with core concrete, and the section of each steel tube thereof may be square, circular, U-shaped, or the like. A square section may have high inertia moment and good anti-bending performance. A circular section steel tube may have a good confinement effect on the core concrete with excellent axial compressive performance.

Figure 2:
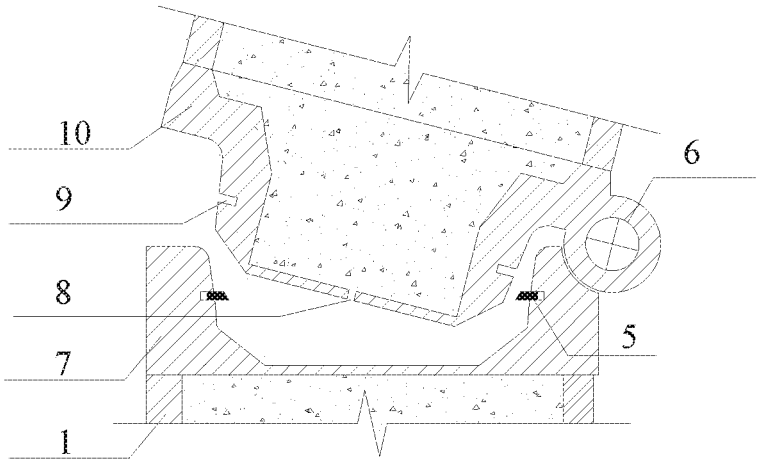
FIG. 2 is a schematic diagram of a hinged connection structure of a joint in the present invention.
Figure 11:
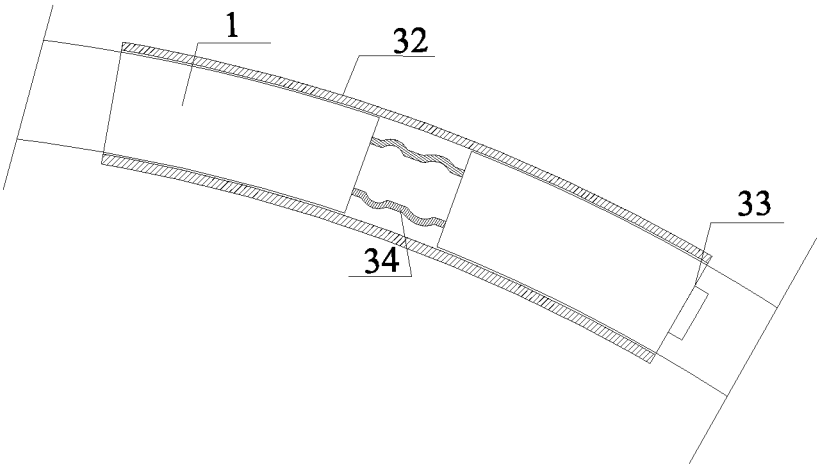
FIG. 11 is a schematic diagram of a quantitative yielding joints in the present invention.

With regard to the joint connection modes of each confined concrete arch 1, there are four types of joints. The first one is flanged connection where every two sections of the arch 1 are connected by a welded flange plate 4 and by using a bolt 2 and two to six 5-30 mm stiffening ribs 3 are welded around the connection of the flange plate 4 and each steel tube to reinforce weak connection positions of the joint, as shown in FIG. 1. The second one is joint hinged connection where a connecting piece welded between adjacent two steel tubes is composed of two ring-shaped steel elements which are connected by a hinge, and when two sections of the arch 1 are folded, the hinge is closed and fixed in position by using a snap spring 5, as shown in FIG. 2. The third one is sleeve connection where a sleeve encloses an arch with a certain gap between the sleeve and the arch to facilitate the sleeve enclosing the arch during construction, and a check block is disposed below the sleeve to prevent the sleeve from sliding down. The last one is a quantitative yielding joint where a quantitative yielding device is like a two-section I-shaped structure with both sides recessed, such that the overall apparent shape is an arc shape or a cylindrical shape and the section shape is a circular shape, and has specific yielding point and yielding quantity and is composed of a quantitative yielding device 34, a sleeve 32 and a retaining collar 33, with the quantitative yielding device 34 being mounted between the ends of two sections of the arch 1, the ends of two sections of the arch being connected by using the sleeve 32, and the retaining collar being located at the lower side of the sleeve, as shown in FIG. 11.

Figure 3:
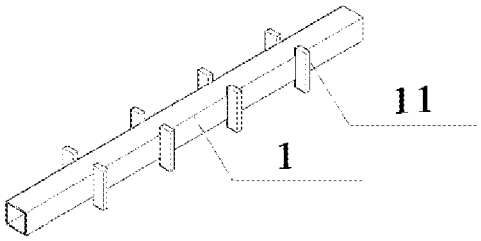
FIG. 3 is a schematic diagram of a welded ribbed plate structure in the present invention.

As shown in FIG. 3, transverse ribbed plates are welded at inner and outer sides of each arch 1. The length of each ribbed plate is greater than the width of the arch 1 by 10 mm to 200 mm, and the ribbed plate is higher than the plane of the arch 1 by 5 mm to 100 mm. A distance between the ribbed plates ranges from 500 mm to 30000 mm. The ribbed plates can increase the contact area of the arch 1 and the shotcrete layer, improve the interaction force of the arch 1 and the shotcrete layer, and enhance the adhesion and integrity of the arch 1 and the concrete.

Telescopic structures are disposed at arch legs of each confined concrete arch 1. Therefore, ground overbreak can be effectively reduced, and the arch legs can reach specified positions conveniently when an overall arch 1 is installed.

Figure 4:
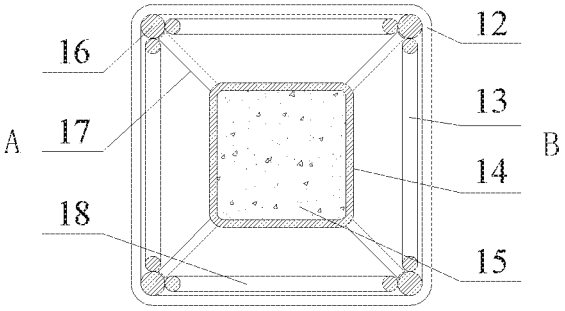
FIG. 4 (*a*) is a sectional diagram of a steel bar enclosure in the present invention.
Figure 4:
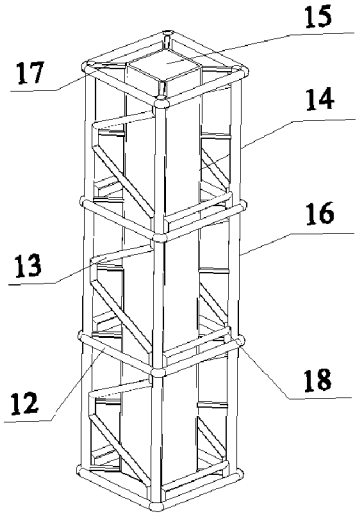

As shown in FIG. 4 (*a*) and FIG. 4 (*b*), a steel bar enclosure may be externally welded on each confined concrete arch 14. The steel bar enclosure comprises four main bars 16, a plurality of stirrups 17, truss bars 13 and U-shaped bars 18. The four main bars 16 are disposed at four sides of the confined concrete arch 14, respectively, and connected with the confined concrete arch 14 by means of fasteners 17, and the main bars 16 are in parallel with the confined concrete arch 14. The stirrups 17 are distributed on a radial plane in the direction of the arch 14 to enclose the main bars 16 and the confined concrete arch 14; and the truss bars 13 and the U-shaped bars 18 are fixed between the adjacent main bars 16. Such a design may improve the stability of the system and the adhesion to the shotcrete layer with better integrity.

(2) Backfilling Prestressed Steel Strand System

The filling material 1-5 may be a concrete type material, and in particular foam concrete and steel fiber reinforced concrete. By backfilling, the characteristics of yielding and high strength are realized with short initial setting time and high early strength. The filling material may be a mixed material having certain plastic deformation capacity and excellent pumpability, and may be injected by way of pumping. The filling material 1-5 allows the generation of a certain prestress therein under the action of the prestressed steel strands 1-4 to form a structure similar to prestressed concrete, thereby effectively improving the overall strength and plastic deformation capacity of the filling material layer, making up the shortfall of brittleness of the filling material, enhancing the overall strength and the anti-deformation capability of the filling material and preventing its partial cracking failure.

(3) Connection Modes Between the Confined Concrete Arches 1

Figure 5:
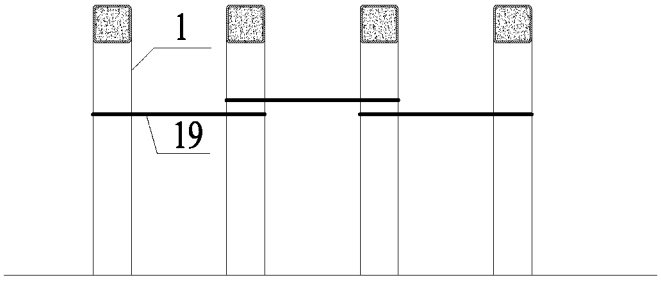
FIG. 5 is a schematic diagram of a longitudinal connecting bar structure in the present invention.
Figure 6:
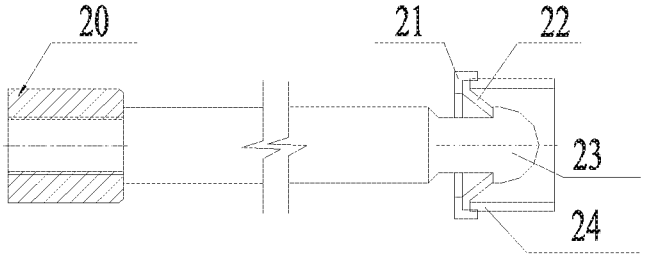
FIGS. 6 (*a*) and (*b*) are schematic diagrams of two longitudinal connecting rod structures in the present invention.
Figure 6:
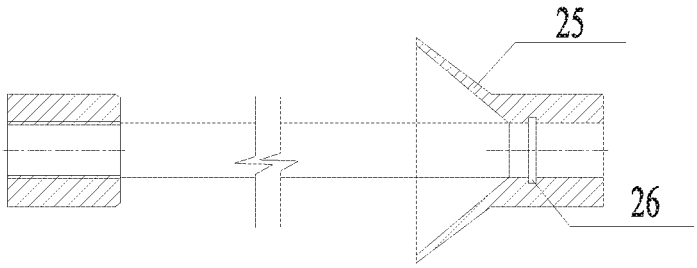

There are mainly two forms of the longitudinal connection device for the arches 1, which may be selected according to site conditions. The first one is longitudinal connecting steel bars directly welded between adjacent two arches, which are alternately welded at the near-surrounding rock sides and the near-tunnel sides of the arches 1, as shown in FIG. 5. The second one is a longitudinal connecting rod, which may be in two forms: one connection mode is that one end of a connecting steel bar is provided with a thread for connection with a connector on one arch 1 before the arch 1 is installed; the other end of the connecting steel bar is provided with a protrusion for insertion into a connector at a corresponding position of a previously assembled confined concrete arch 1 when confined concrete arches 1 are assembled; and then inverted wedge-shaped snap rings are utilized for automatic fixation to connect the two arches 1, as shown in FIG. 6 (*a*). The other connection mode is that the other end of the connecting steel bar is provided with an annular groove for insertion into a connector at a corresponding position of a previously confined concrete arch, and a tensioned snap spring is clamped in the annular groove for fixation, as shown in FIG. 6 (*b*).

Figure 7:
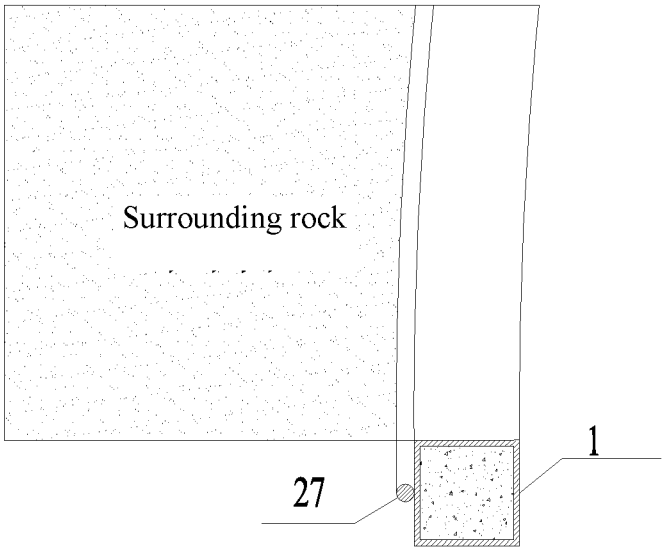
FIG. 7 is a schematic diagram of a reinforcing steel bar structure in the present invention.

As shown in FIG. 7, steel bars or steel plates are utilized to reinforce greater load-carrying parts of the arches 1. Steel bars having a diameter of 10-60 mm or steel plates having a thickness of 10-60 mm and a width of 20-200 mm are welded at surrounding rock sides of the tops and lateral walls of the arch 1 to enhance the strength of the crucial positions and improve the overall bearing capacity of the arch 1.

Figure 9:
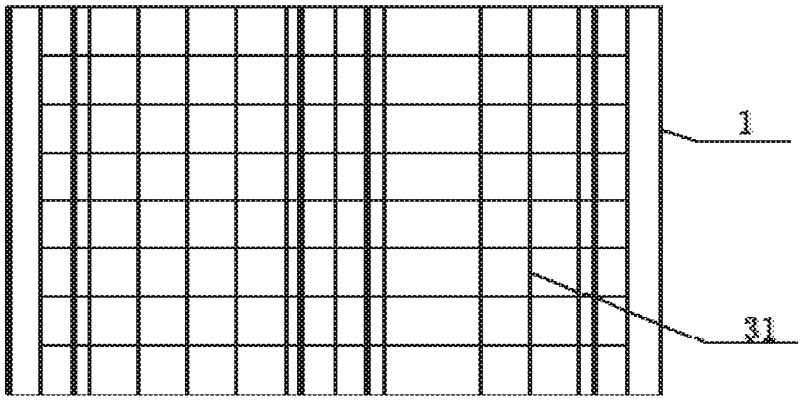
FIG. 9 is a schematic diagram of a steel bar mesh structure in the present invention.
Figure 10:
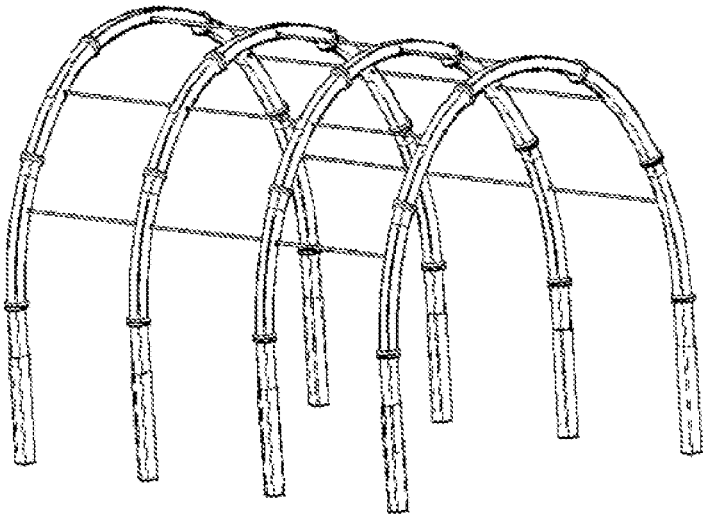
FIG. 10 is a schematic diagram of an overall architecture (without steel bar meshes) in the present invention.

As shown in FIG. 9, the steel bar meshes are arranged between adjacent two confined concrete arches, respectively, which are double layers of steel bar meshes welded at both surrounding rock sides and tunnel sides of the arches 1, respectively. A welding distance between each steel bar mesh and each arch 1 is equal to half the width of each arch 1, such that the steel bar meshes at both sides of each arch 1 can contact with each other. Coverage of the steel bar meshes can increase friction between the surface of each steel tube and each shotcrete layer providing better adhesion of each steel arch and the shotcrete layer, meanwhile, each steel bar mesh plays a role of a filling retaining plate for backfilling, thereby preventing the filling material from flowing and facilitating the backfilling.

(4) Filling Concrete in the Confined Concrete Arches 1

The core concrete filling the confined concrete arches 1 may be ordinary concrete or steel fiber reinforced concrete. The selection of the strength grade of the concrete is determined depending on site specific conditions. Meanwhile, a certain proportion of pumping aid and early strength agent are added, such that the confined concrete arches 1 are easy to fill with their strength increasing quickly, allowing the early strength of the core concrete to quickly reach a designed value.

Figure 8:
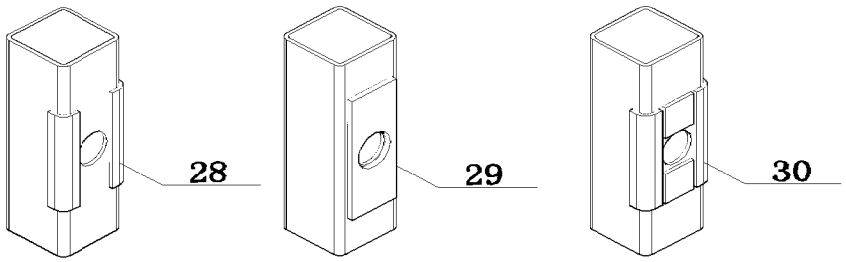
FIGS. 8 (*a*), (*b*) and (*c*) are schematic diagrams of a grouting opening reinforcement structure in the present invention.

As shown in FIG. 8 (*a*), FIG. 8 (*b*) and FIG. 8 (*c*), with regard to the reinforcement of the grouting opening of each arch 1 of the confined concrete support system for a tunnel, the grouting opening reinforcement mode may be lateral bending steel plate reinforcement, opening steel plate reinforcement or peripheral steel plate reinforcement. The ratio of the thickness of each steel plate to the wall thickness of each steel tube of the arch is 0.5-4, and the length of the steel plate is 1.2-3 times the diameter of each grouting opening. By reinforcement, the stress concentration degree is reduced and the ultimate bearing capacity is improved.

Different filling processes may be selected according to different construction modes. A confined concrete arch 1 in which concrete is injected and cured in advance may be employed for installation, and flanged splicing is performed by a machine in conjunction with a worker during site installation. Alternatively, a confined concrete arch 1 not filled with concrete is installed first, and then filling of concrete is carried out from bottom to top from the grouting openings in the arch legs. Moreover, the arches 1 may be prefabricated and then connected by hinges.

(5) Parameters of the Shotcrete Layer

The shotcrete layer may be formed by ordinary concrete or steel fiber reinforced concrete. Therefore, the anti-tensile, anti-bending, anti-impact and anti-fatigue properties of the concrete can be significantly improved with good ductility.

Further, according to the site geological conditions, the distance between the confined concrete arches 1 may be appropriately increased and the thickness of the shotcrete layer may be appropriately reduced in contrast with the arches 1 in traditional support forms.

While specific embodiments of the present invention are described above in conjunction with the drawings, they are not intended to limit the scope of protection of the present invention. A person skilled in the art should understand that various modifications or variations made by those skilled in the art on the basis of the technical solutions in the present invention without creative work shall still be encompassed in the scope of protection of the present invention.

The invention claimed is:

1. A high-strength confined concrete support system for an underground tunnel, comprising: multiple confined concrete arches, bolts and cables, and a prestressed steel strand backfilling system, wherein:

the confined concrete arches form an internal bearing layer of the support system;

the bolts and the cables form an external bearing layer of the support system;

the bolts and the cables are embedded into surrounding rock, and a filling material is between the arches and the surrounding rock to form an intermediate bearing structure layer;

the confined concrete arches all support the surrounding rock of the tunnel and are sequentially arranged along the tunnel;

every two adjacent confined concrete arches are connected by a longitudinal connection structure;

the support system is provided with a plurality of layers of steel bar meshes, the plurality of steel bar meshes including a first layer on the surrounding rock side and a second layer on the tunnel side, and shotcrete layers are on the support system and the steel bar meshes;

the prestressed steel strand backfilling system comprises a prestressed steel strand system and the filling material;

the prestressed steel strand system comprises steel strands that connect the arches with the bolts, and the cables sequentially run through arch cable-passing holes and tray cable-passing holes to form a continuous grid between outer edges of the arches and the surface of the surrounding rock, thereby connecting the arches with the bolts and the cables;

the filling material fills space between each confined concrete arch and the surrounding rock to equalize a load on the confined concrete arch and generate a prestress;

each confined concrete arch is constituted by splicing a plurality of steel tubes;

the steel tubes are connected by joints;

the joints are connecting pieces; and each connecting piece comprises two ring-shaped steel elements which are connected by a hinge, and when two steel tubes are folded, the hinge is closed and fixed in position by using a snap spring.

2. The high-strength confined concrete support system for an underground tunnel according to claim 1, wherein each confined concrete arch is an arch bracket structured by filling the steel tubes with core concrete; and the confined concrete arches have different section shapes due to the fact that factors such as lateral pressure coefficient, burial depth and geological condition of the tunnel are different.

3. The high-strength confined concrete support system for an underground tunnel according to claim 1, wherein telescopic structures are disposed at legs of the confined concrete arches.

4. The high-strength confined concrete support system for an underground tunnel according to claim 1, wherein each confined concrete arch comprises a steel tube filled with core concrete.

5. The high-strength confined concrete support system for an underground tunnel according to claim 1, wherein the confined concrete arches are provided with reinforcement structures at grouting openings; and each grouting opening reinforcement structure includes lateral bending steel plate reinforcement, opening steel plate reinforcement and/or peripheral steel plate reinforcement.

6. The high-strength confined concrete support system for an underground tunnel according to claim 1, wherein ribbed plates are disposed on each confined concrete arch, and the ribbed plates are welded at inner and outer sides of the arch; the length of each ribbed plate is greater than the width of the arch by 10 mm to 200 mm, and the ribbed plate is higher than the plane of the arch by 5 mm to 100 mm; and the distance between the ribbed plates ranges from 500 mm to 30000 mm.

7. The high-strength confined concrete support system for an underground tunnel according to claim 1, wherein the longitudinal connection structure is longitudinal connecting bars which are welded between adjacent two confined concrete arches and alternately welded at surrounding rock sides and tunnel sides of different confined concrete arches; and the longitudinal connecting bars are welded on both the surrounding rock side and the tunnel side.

8. The high-strength confined concrete support system for an underground tunnel according to claim 1, wherein steel bars or steel plates are utilized to reinforce crucial load-carrying parts confined concrete arch; steel bars or steel plates are welded at surrounding rock sides of the tops and lateral walls of each arch to enhance the strength of the crucial positions and improve the overall bearing capacity of the arch.

9. The high-strength confined concrete support system for an underground tunnel according to claim 1, wherein the steel bar meshes are arranged between adjacent two confined concrete arches, respectively, which are double layers of steel bar meshes welded at both surrounding rock sides and tunnel sides of confined concrete arch, respectively; the welding distance between each steel bar mesh and each arch is equal to half the width of each confined concrete arch, such that the steel bar meshes at both sides of each arch contact with each other; coverage of the steel bar meshes provides friction between the surface of each steel tube and each shotcrete layer to facilitate adhesion of each steel arch and the shotcrete layer, and each steel bar mesh plays a role of a filling retaining plate for backfilling, thereby (i) preventing the filling material from flowing and (ii) facilitating the backfilling.

10. The high-strength confined concrete support system for an underground tunnel according to claim 1, wherein a steel bar enclosure is externally welded on each confined concrete arch; the steel bar enclosure comprises four main bars, a plurality of stirrups, truss bars and U-shaped bars; the four main bars are disposed at four sides of the confined concrete arch, respectively, and connected with the confined concrete arch by fasteners, and the main bars are in parallel with the confined concrete arch; the stirrups are distributed on a radial plane in the direction of the arch to enclose the main bars and the confined concrete arch; and the truss bars and the U-shaped bars are fixed between the adjacent main bars.

11. The high-strength confined concrete support system for an underground tunnel according to claim 1, wherein the filling material is a concrete type material, and the filling material allows the generation of a certain prestress therein under the action of the prestressed steel strands.

12. A high-strength confined concrete support system for an underground tunnel, comprising: multiple confined concrete arches, bolts and cables, and a prestressed steel strand backfilling system, wherein:

the confined concrete arches form an internal bearing layer of the support system;

the bolts and the cables form an external bearing layer of the support system;

the bolts and the cables are embedded into surrounding rock, and a filling material is between the arches and the surrounding rock to form an intermediate bearing structure layer;

the confined concrete arches all support the surrounding rock of the tunnel and are sequentially arranged along the tunnel;

every two adjacent confined concrete arches are connected by a longitudinal connection structure;

the support system is provided with a plurality of layers of steel bar meshes, the plurality of steel bar meshes including a first layer on the surrounding rock side and a second layer on the tunnel side, and shotcrete layers are on the support system and the steel bar meshes;

the prestressed steel strand backfilling system comprises a prestressed steel strand system and the filling material;

the prestressed steel strand system comprises steel strands that connect the arches with the bolts, and the cables sequentially run through arch cable-passing holes and tray cable-passing holes to form a continuous grid between outer edges of the arches and the surface of the surrounding rock, thereby connecting the arches with the bolts and the cables;

the filling material fills space between each confined concrete arch and the surrounding rock to equalize a load on the confined concrete arch and generate a prestress;

the longitudinal connection structure is a longitudinal connecting rod;

one end of a connecting steel bar is provided with a thread for connection with a connector on a confined concrete arch before the confined concrete arch is installed;

the other end of the connecting steel bar is provided with a protrusion for insertion into a connector at a corresponding position of a previously assembled confined concrete arch when confined concrete arches are assembled; and inverted wedge-shaped snap rings are utilized for automatic fixation to connect the two confined concrete arches.

13. The high-strength confined concrete support system for an underground tunnel according to claim 12, wherein each confined concrete arch is constituted by a plurality of spliced steel tubes; the steel tubes are connected by a sleeve; the sleeve encloses the arch with a certain gap between the sleeve and the arch to facilitate the sleeve enclosing the arch during construction; and a structure is disposed below the sleeve to prevent the sleeve from sliding down.

14. The high-strength confined concrete support system for an underground tunnel according to claim 12, wherein the other end of the connecting steel bar of the longitudinal connecting rod is provided with an annular groove for insertion into a connector at a corresponding position of a previously confined concrete arch, and a tensioned snap spring is clamped in the annular groove for fixation.

15. The high-strength confined concrete support system for an underground tunnel according to claim 12, wherein each confined concrete arch is constituted by splicing a plurality of steel tubes; the steel tubes are connected by joints; each joint is in a flanged connection mode; every two steel tubes are connected by a welded flange plate and by using a bolt; a plurality of stiffening ribs are welded around the connection of the flange plate and each steel tube to reinforce weak connection positions of the joint.

16. A high-strength confined concrete support system for an underground tunnel, comprising: multiple confined concrete arches, bolts and cables, and a prestressed steel strand backfilling system, wherein:

the confined concrete arches form an internal bearing layer of the support system;

the bolts and the cables form an external bearing layer of the support system;

the bolts and the cables are embedded into surrounding rock, and a filling material is between the arches and the surrounding rock to form an intermediate bearing structure layer;

the confined concrete arches all support the surrounding rock of the tunnel and are sequentially arranged along the tunnel;

every two adjacent confined concrete arches are connected by a longitudinal connection structure;

the support system is provided with a plurality of layers of steel bar meshes, the plurality of steel bar meshes including a first layer on the surrounding rock side and a second layer on the tunnel side, and shotcrete layers are on the support system and the steel bar meshes;

the prestressed steel strand backfilling system comprises a prestressed steel strand system and the filling material;

the prestressed steel strand system comprises steel strands that connect the arches with the bolts, and the cables sequentially run through arch cable-passing holes and tray cable-passing holes to form a continuous grid between outer edges of the arches and the surface of the surrounding rock, thereby connecting the arches with the bolts and the cables;

the filling material fills space between each confined concrete arch and the surrounding rock to equalize a load on the confined concrete arch and generate a prestress;

each confined concrete arch is constituted by a plurality of spliced steel tubes;

the steel tubes are connected by quantitative yielding joints, and each joint is constituted by a quantitative yielding device, a sleeve and a retaining collar;

the quantitative yielding device is mounted between the ends of two sections of the arch;

the ends of two sections of the arch are connected by using the sleeve; and the retaining collar is located at the lower side of the sleeve.

17. The high-strength confined concrete support system for an underground tunnel according to claim 16, wherein the quantitative yielding device is fabricated as required by design; when a load on an arch reaches a certain limit, the quantitative yielding device achieves yielding through deformation thereof, and has a yielding point and a yielding quantity.

18. The high-strength confined concrete support system for an underground tunnel according to claim 16, wherein the quantitative yielding device has a particular load-displacement curve form under pressure, which, as required, is a constant-resistance yielding form where deformation continues and the load remains unchanged when the pressure reaches a certain degree, or a resistance-increased yielding form where the load and the deformation slowly increase at the same time, a phased yielding.

* * * * *